United States Patent [19]

Zimmerman

[11] Patent Number: 4,848,010

[45] Date of Patent: Jul. 18, 1989

[54] BACKHOE MACHINE

[76] Inventor: Harold M. Zimmerman, Rte. 1, Wabash Rd., Ephrata, Pa. 17522

[21] Appl. No.: 77,752

[22] Filed: Jul. 27, 1987

[51] Int. Cl.[4] ..... E02F 5/22; E02F 5/02

[52] U.S. Cl. ..... 37/103; 414/697; 414/705; 414/718

[58] Field of Search ..... 37/117.5, 118 R, 103; 414/696, 697, 705, 718, 687; 212/245

[56] References Cited

U.S. PATENT DOCUMENTS

| | | | |
|---|---|---|---|
| 1,706,257 | 3/1929 | Ronning | 37/117.5 X |
| 2,718,312 | 9/1955 | Pilch | 212/245 X |
| 3,270,894 | 9/1966 | Elliott et al. | 212/245 X |
| 3,403,802 | 10/1968 | Lundell | 37/117.5 X |
| 3,495,727 | 2/1970 | Long | 212/245 X |
| 3,704,754 | 12/1972 | Layton | 37/117.5 X |
| 3,776,318 | 12/1973 | Layton | 172/777 |
| 3,822,756 | 7/1974 | Martin | 180/14 R |
| 3,941,262 | 3/1976 | Moser et al. | 37/118 R X |
| 3,987,563 | 10/1976 | Baur | 37/118 R X |
| 4,088,236 | 5/1978 | Moore | 37/117.5 X |
| 4,189,854 | 2/1980 | Haynes | 37/117.5 |
| 4,222,186 | 9/1980 | Molby | 37/117.5 X |
| 4,255,884 | 3/1981 | Williams | 37/117.5 |
| 4,360,980 | 11/1982 | Jarvis | 37/117.5 |
| 4,463,507 | 8/1984 | Gaub | 37/117.5 |
| 4,464,852 | 8/1984 | Rice | 37/117.5 |
| 4,550,512 | 11/1985 | Felster | 37/117.5 |

FOREIGN PATENT DOCUMENTS

| | | | |
|---|---|---|---|
| 1099472 | 2/1961 | Fed. Rep. of Germany | 37/118 R |
| 852925 | 11/1960 | United Kingdom | . |

*Primary Examiner*—E. H. Eickholt

[57] ABSTRACT

A backhoe machine is disclosed wherein the entire articulated boom is mounted to a carriage for movement relative thereto about two normally generally horizontal pivot axes. The entire carriage is rotatable about a generally vertical axis to permit operation of the backhoe assembly laterally of the machine with the operator's station constantly facing the operation of the backhoe assembly. The first pivot axis for the articulated boom extends outwardly from the carriage and permits the entire boom to be canted relative to the carriage upon which it is mounted. The second pivot axis for the articulated boom is carried by a mounting frame and is rotatable about the first horizontal pivot axis to permit an extension of the articulated boom while being tilted relative to the carriage.

16 Claims, 5 Drawing Sheets

Fig. 5
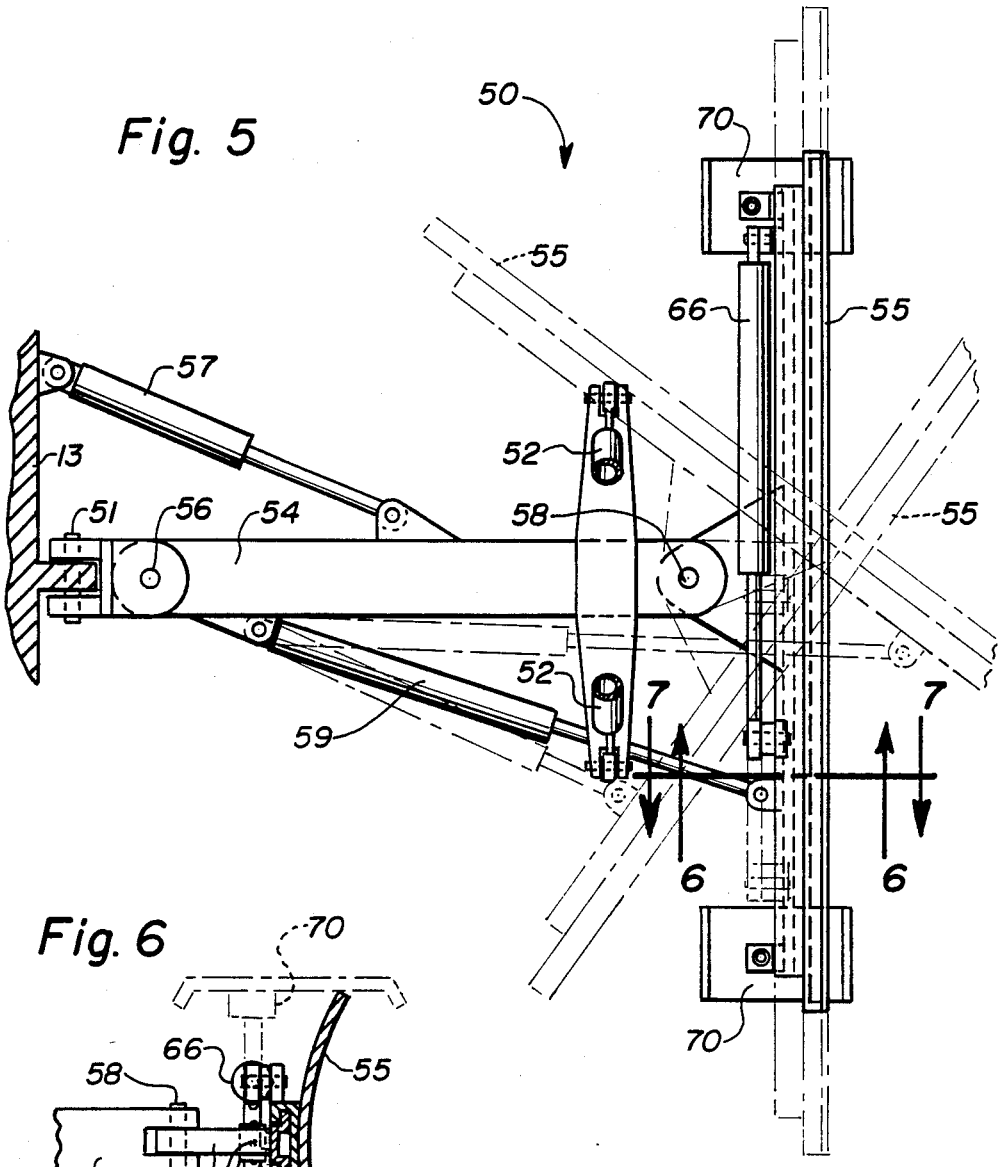
Fig. 6
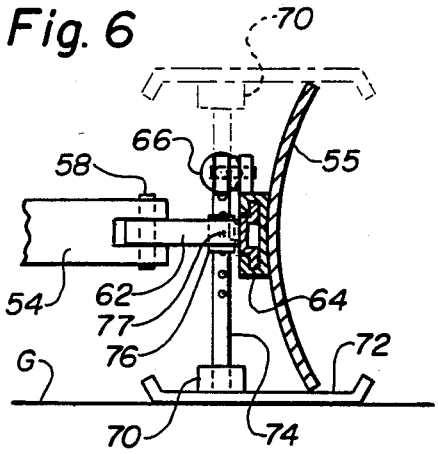
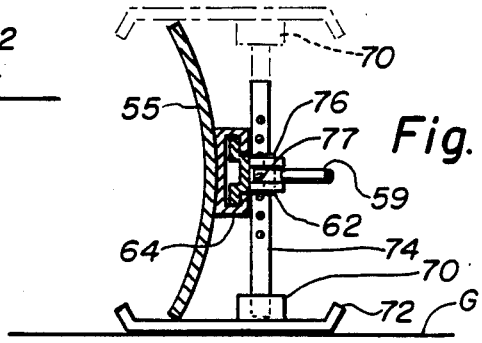
Fig. 7

BACKHOE MACHINE

BACKGROUND OF THE INVENTION

The present invention relates generally to earthworking machines and, more particularly, to a backhoe machine comprising a part of the multi-purpose earthworking machine.

Conventional backhoes are equipped with an articulated boom having an earthworking tool movably attached thereto. The boom is normally pivotable about a horizontal axis to permit extension of the articulated boom and about a generally vertical axis to permit the boom to be swung transversely and, thereby, permit operation of the earthworking tool laterally of the frame of the machine. The operator's station in such backhoes is fixed relative to a given orientation and the boom is permitted to swing laterally relative thereto. Furthermore, the articulated boom is generally operable only in a vertical plane extending outwardly from the vertical pivot axis to move the earthworking tool toward and away from the operator's station.

For such backhoe machines, the operator must look laterally when the earthworking tool is positioned laterally while his controls remain fixed in a longitudinally facing direction. Furthermore, the earthworking tool cannot be rotated relative to the boom in a "Z-plane" without the addition of a special canting mechanism interconnecting the earthworking tool and the articulated boom which is expensive, complicated, and is operable only to cant the earthworking tool instead of the entire articulated boom.

SUMMARY OF THE INVENTION

It is an object of this invention to overcome the aforementioned disadvantages of the prior art by providing a backhoe machine having the articulated boom mounted for pivotal movement about an outwardly extending horizontal pivot axis to permit the entire boom assembly to be canted relative to the carriage to which it is attached.

It is another object of this invention to provide a backhoe machine having a carriage containing an operator's station to be rotatable about a generally vertical axis with the backhoe assembly.

It is a feature of this invention that the operator's station will be rotated with the backhoe assembly about a generally vertical axis to permit the operation of the earthworking tool mounted at the remote end of the articulated boom to be accomplished directly in front of the operator.

It is advantage of this invention that the operator has his operating controls directly forwardly of him during operation of the backhoe machine even when the earthworking tool is positioned laterally of the machine.

It is another feature of this invention that the entire articulated boom can be canted relative to the carriage upon which it is mounted.

It is still another object of this invention to provide two normally horizontally extending pivot axes for movement of the backhoe assembly relative to the carriage upon which it is mounted.

It is yet another object of this invention that the backhoe operation can be incorporated into a multi-purpose earthworking machine as one of several earthworking functions.

It is yet another feature of this invention that the articulated boom includes a mounting frame affixed to the inner race of a thrust ring having is outer race affixed to the carriage to permit rotation of the articulated boom relative to the carriage.

It is still another advantage of this invention that the mounting frame carries the second generally horizontal pivot for rotation therewith about the first generally horizontal pivot axis which corresponds to the center of the thrust ring to which the mounting frame is affixed.

It is yet another object of this invention that the rotational movement of the mounting frame and the articulated boom relative to the carriage can be accomplished by a hydraulic cylinder interconnecting the carriage and the rotatable mounting frame.

It is a further object of this invention to provide a backhoe machine forming an operational part of a multi-purpose earthworking machine which is durable in construction, inexpensive of manufacture, carefree of maintenance, facile in assemblage and simple and effective in use.

These and other objects, features and advantages are accomplished according to the instant invention by providing a backhoe machine wherein the entire articulated boom is mounted to a carriage for movement relative thereto about two normally generally horizontal pivot axes. The entire carriage is rotatable about a generally vertical axis to permit operation of the backhoe assembly laterally of the machine with the operator's station constantly facing the operation of the backhoe assembly. The first pivot axis for the articulated boom extends outwardly from the carriage and permits the entire boom to be canted relative to the carriage upon which it is mounted. The second pivot axis for the articulated boom is carried by a mounting frame and is rotatable about the first horizontal pivot axis to permit an extension of the articulated boom while being tilted relative to the carriage.

BRIEF DESCRIPTION OF THE DRAWINGS

The advantages of this invention will become apparent upon consideration of the following detailed disclosure of the invention, especially when taken in conjunction with the accompanying drawings wherein:

FIG. 5 is a partial cross-sectional view taken along lines 5—5 of FIG. 1 to better show the scraper assembly, the tilting movement of the scraper blade and the transverse movement of the scraper blade relative to the support arm being respectively shown in phantom;

FIG. 6 is a cross-sectional detail view taken along lines 6—6 of FIG. 5 to show the mounting of the scraper blade to the support arm, the alternate positioning of the stabilizer pad being shown in phantom;

FIG. 7 is a cross-sectional detail view taken along lines 7—7 of FIG. 5 to better show the mounting of the scraper blade to the support arm;

DETAILED DESCRIPTION OF THE PREFERRED EMBODIMENT

Figure 1:
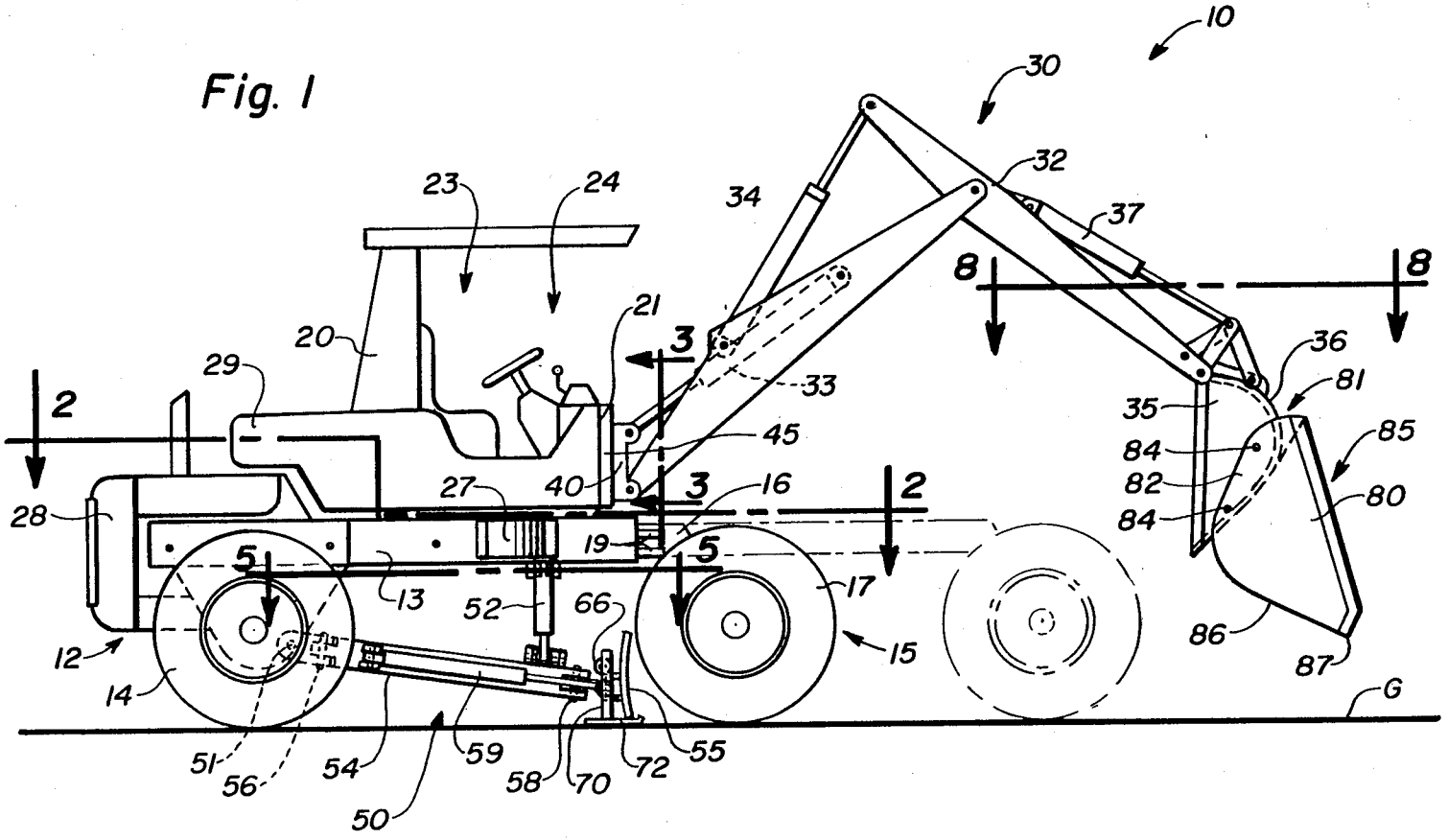
FIG. 1 is a side elevational view of an earthworking machine incorporating the principles of the instant invention, the telescopic movement of the front wheel assembly being shown in phantom.
Figure 2:
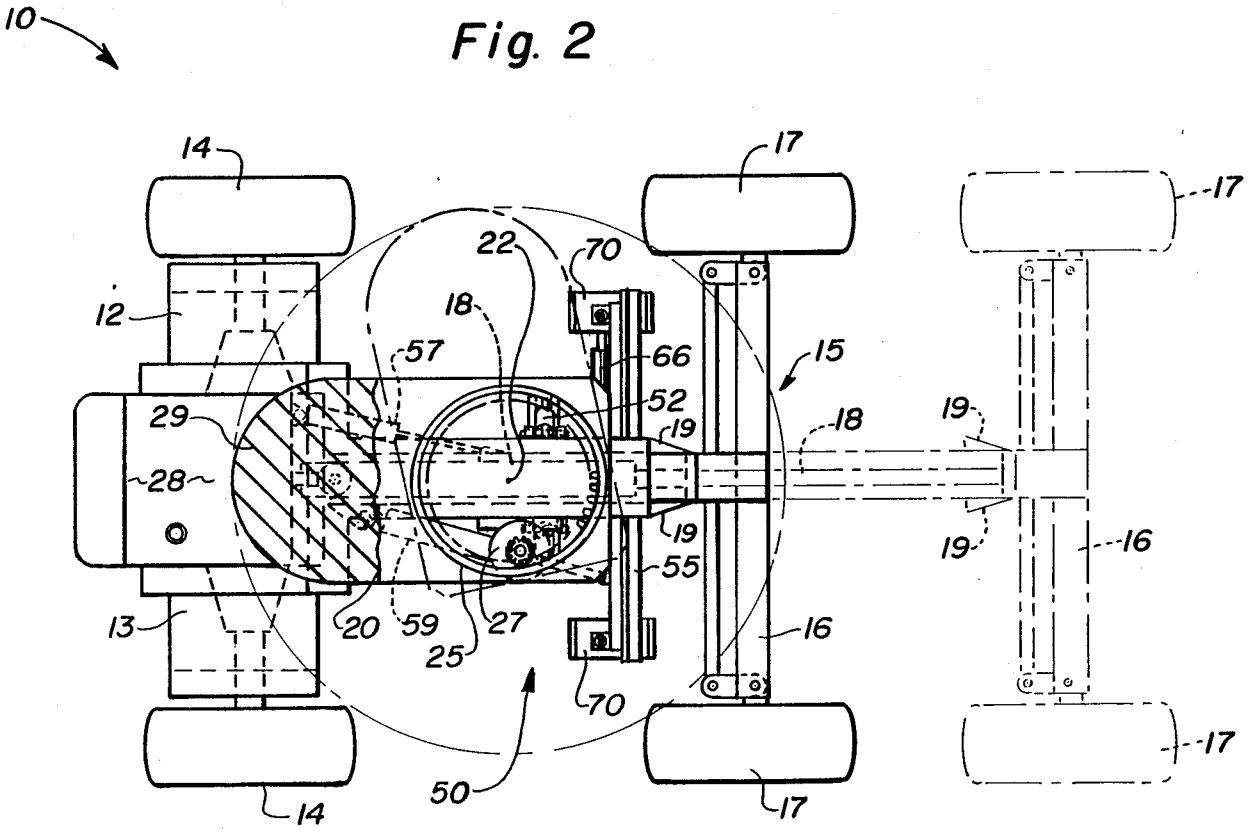
FIG. 2 is a cross-sectional view of the earthworking machine taken along lines 2—2 of FIG. 1, the rotational movement of the carriage being shown in phantom as well as the telescopic movement of the front wheel assembly.

Referring now to the drawings and, more particularly, to FIGS. 1 and 2, a front elevational view and a cross-sectional view of the multi-purpose earthworking machine incorporating the principles of the instant invention can best be seen. The earthworking machine 10 is provided with a mobile frame 12 which includes a rear subframe 13 rotatably mounting a pair of rear ground engaging wheels 14 and a front wheel assembly 15 which is provided with a pair of steerable front ground engaging wheels 17. The front wheel assembly 15 includes a front subframe 16 telescopically received within the rear subframe 13 and movable in a fore-and-aft direction by means of a hydraulic cylinder 18 positioned internally of the subframes 13,16 to affect the telescopic movement therebetween. Although the drawings depict a single telescopically related subframe member positioned along the centerline of the machine 10, it should be realized that a pair of transversely spaced telescopically related subframe members could be alternatively provided. Limits to the telescopic movement of the front subframe 16 can be hydraulically provided in conjunction with the hydraulic cylinder 18 or mechanically such as by an internal ring or the wing tabs 19.

The frame 12 has a carriage 20 rotatably mounted thereon for rotation about a generally vertical axis or rotation 22. The carriage 20 supports an operator's station 23 with controls, generally indicated with the reference numeral 24, to affect operation of the machine 10. The carriage 20 is provided with a ring gear 25 rotatably supported by the frame 12 and engageable with a motor 27, preferably hydraulically driven, to affect rotation of the ring gear 25 and attached carriage 20. The axis of rotation 22 corresponds to the center of said ring gear 25 forming the means of rotation of the carriage 20. It will be appreciated by one skilled in the art that a carriage 20 mounted in the manner described above is capable of rotation through an entire 360° arc; however, from a practical consideration, an arc of 270° centered about a fore-and-aft extending orientation would be sufficient for most operational purposes. An engine 28 can be mounted on the frame 12 rearwardly of the carriage 20 to provide operational power for the earthworking machine 10 and can be situated to permit effective movement of the carriage 20 about the vertical axis 22 with a rearward counterweight 29 being positioned to clear the engine 28 during its rotative movement.

A backhoe assembly 30 is mounted on the front face 21 of the carriage 20 and includes an articulated boom 32 hydraulically controlled in a conventional manner by hydraulic cylinders 33,34, and an earthworking tool shown in the form of a backhoe bucket 35 movably mounted on the end of the boom 32 and controlled in a conventional manner by means of a hydraulic cylinder 37. The backhoe assembly 30 is operable from the front face 21 of the carriage 20 throughout the entire range of rotation of the carriage 20 about the generally vertical axis 22 so as to be operable beyond the frame 12 to engage the ground G. Since the operator's station 23 rotates with the carriage 20, the operator will always have the digging operation of the backhoe assembly 30 occurring immediately in front of him with the controls 24 being easily accessible throughout the entire range of movement of the carriage 20, even when the backhoe assembly 30 is working laterally of the frame 12.

Figure 3:
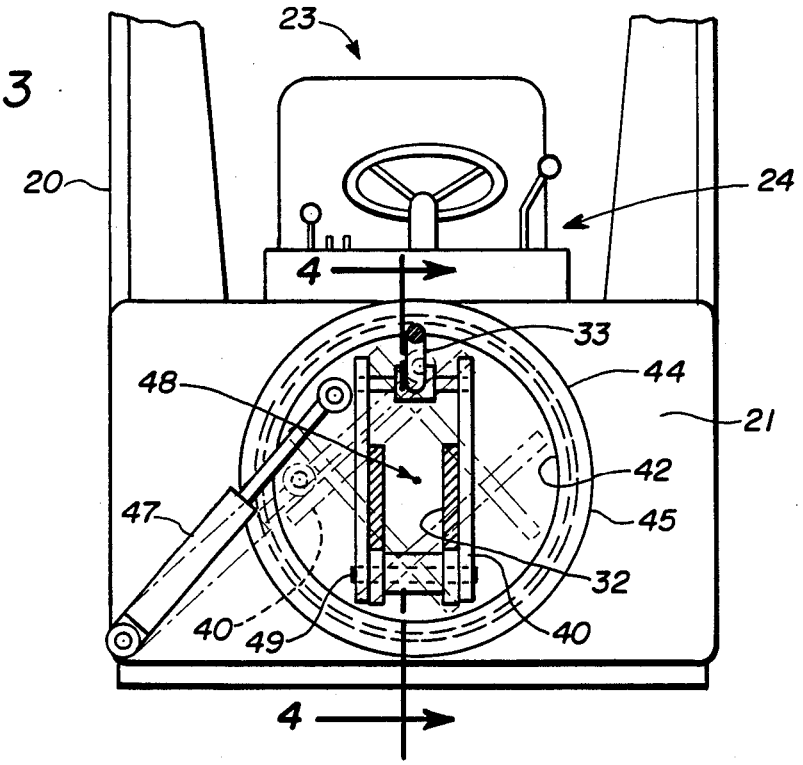
FIG. 3 is a partial cross-sectional view of the earthworking machine taken along lines 3—3 of FIG. 1 to show the thrust ring connecting the backhoe assembly to the front fraceof the carriage, the rotational movement of the mounting frame of the backhoe assembly being shown in phantom.
Figure 4:
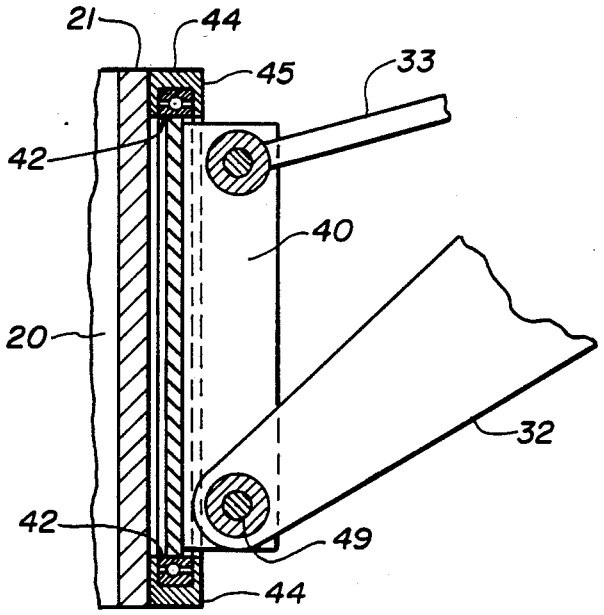
FIG. 4 is a partial cross-sectional view taken along lines 4—4 of FIG. 3 to show greater detail of the mounting of the backhoe assembly to the front face of the carriage.

Referring now to FIGS. 1, 3 and 4, the structure for mounting the backhoe assembly 30 to the front face 21 of the carriage 20 can best be seen. The backhoe assembly 30 includes a mounting frame 40 to which the articulated boom 32 and the hydraulic cylinder 33 are pivotally connected, the vertical movement of the boom 32 being controlled by the selectively variable length of the hydraulic cylinder 33 in a conventional manner. The mounting frame 40 is affixed to the inner race 42 of a thrust ring 45, the outer race 44 of the thrust ring 45 being affixed to the front face 21 of the carriage 20. The rotative movement of the mounting frame 40 and consequently the inner race 42 of the thrust ring 45 is controlled by a hydraulic cylinder 47 interconnecting the front face 21 of the carriage 20 and the mounting frame 40. As been seen in FIG. 3, the extension and contraction of the hydraulic cylinder 47 can affect a rotation of the mounting frame 40 through an arc of approximately 90° centered about a configuration in which the hydraulic cylinder 33 is positioned vertically above the pivot axis 49 of the articulated boom 32 carried by the mounting frame 40, which corresponds to the vertical orientation of the boom 32. This particular configuration described above permits the entire backhoe assembly 30 to be canted or tilted about a horizontal axis 48 extending outwardly from the front face 21 of the carriage 20, the horizontal axis 48 corresponding to the center of the thrust ring 45, thereby permitting the entire backhoe assembly 30 to be moved in the "Z plane". The normally horizontal pivot axis 49 of the boom 32 rotates with the mounting frame 40 about the horizontal axis of rotation 48, permitting the articulated boom 32 a full range of movement toward and away from the carriage 20 during its entire range of movement about the horizontal axis of rotation 48.

As can be seen in FIGS. 1, 2 and 5–7, the earthworking machine 10 is also provided with a scraper assembly 50 pivotally attached to the rear subframe 13 to permit a vertical movement thereof which can be affected by hydraulic cylinders 52. The scraper assembly 50 is provided with a forwardly extending support arm 54 upon which is mounted a scraper blade 55. The support arm 54 is articulated and is selectively movable about a first horizontally extending pivot 51 carried by the rear subframe 13 to permit the vertical movement of the scraper assembly 50 by the hydraulic cylinders 52, about a first generally vertical pivot 56 to permit a side-to-side swinging of the support arm 54 and attached blade 55 controlled by the hydraulic cylinder 57 interconnecting the rear subframe 13 and the support arm 54, about a second generally vertical pivot 58 to permit an angular movement of the scraper blade 55 relative to the support arm 54 as affected by the hydraulic cylinder 59 interconnecting the support arm 54 and a hat-shaped section 62 mounting the scraper blade 55 to the support arm 54.

The hat-shaped section 62 is pivotally connected to the support arm 54 by the pivot 58 and is engaged by the scraper blade 55 by means of a corresponding C-shaped channel into which the hat-shaped section 62 is slidably received. A hydraulic cylinder 66 interconnecting the hat-shaped section 62 and the C-shaped channel 64 selectively permits the blade 85 to be transversely shifted with respect to the support arm 54. Accordingly, it can be seen that the scraper assembly 50 can be positioned in virtually any configuration between the front and rear wheels 17,14 to affect the desired grading operation, with the support arm 54 being configured to push the scraper blade 55 across the ground G rather than pulling the blade across the ground as is typical with prior art graders.

Referring again to FIGS. 1, 2, and 5–7, the scraper assembly 50 is also provided with a pair of transversely spaced stabilizer pads 70 mounted adjacent opposing ends of the scraper blade 55. Each stabilizer pad 70 includes a ground engaging member 72 which is selectively positionable beneath the scraper blade 55 to serve as stabilizing outriggers when the earthworking machine 10 is being utilized as a backhoe or loader as will be described in greater detail below. Each stabilizer pad 70 is shown as having a support shaft 74 extending upwardly from the ground engaging member 72 and being received through a sleeve 76 supported by the hat-shaped member 62. A pin 77 extending through the sleeve 76 and through a corresponding hole in the support shaft 74 locks the stabilizer pad 70 into its preselected position. To facilitate proper engagement between the ground engaging member 72 and the scraper blade 55, due to the capability of the blade 55 to be moved transversely with respect to the hat-shaped member 62, each sleeve 76 is positionably connected to the hat-shaped member 62 to permit a selective corresponding movement of the sleeve 76 in a transverse direction relative thereto.

When the machine 10 is being utilized as a grader and, consequently the stabilizer pads 70 need to be moved into a non-ground engaging position, the support shaft 74 can be reinserted through the top of the sleeve and pinned into position by the pin 77 such that the ground engaging member 72 rests on top of the scraper blade 55 as shown in phantom in FIGS. 6 and 7. Alternatively, the stabilizer pad 70 could be swivelly mounted to the hat-shaped section 62 to permit the ground engaging member 72 to be pivoted into respective ground engaging and non-ground engaging positions relative to the scraper blade 55. The use of the blade 55 to rest upon the ground engaging member 72 when used as a stabilizing outrigger permits the hydraulic cylinders 52 to exert downward pressure thereon to fully affect a stabilizing of the machine 10 when it is being utilized as a backhoe.

Figure 9:
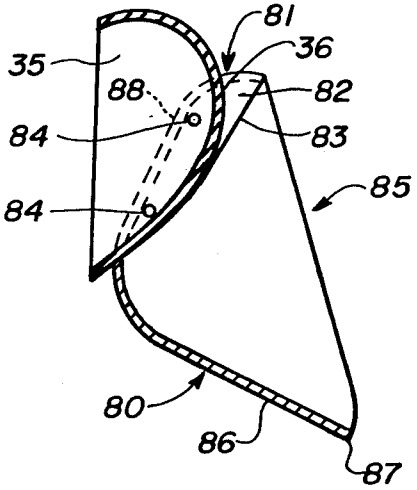
FIG. 9 is a partial cross-sectional detail view taken along lines 9—9 of FIG. 8 to show the mounting of the loader bucket to the backhoe bucket.
Figure 8:
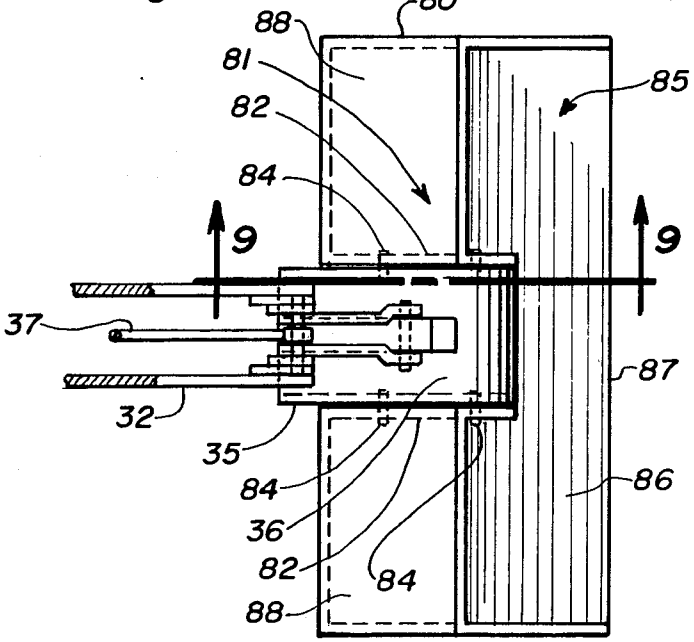
FIG. 8 is a partial cross-sectional view taken along lines 8—8 of FIG. 1 to show the mounting of the loader bucket to the backhoe bucket forming a part of the backhoe assembly.

Referring now to FIGS. 1, 8 and 9, it can be seen that the backhoe bucket can be equipped with a loader bucket 80 having a floor portion 86 equipped with a material engaging edge 87 to permit the machine 10 to be utilized as a loader, as well as a backhoe and grader. The back wall 88 of the loader bucket 80 is provided with a mounting apparatus 81 including fore-andaft extending mounting flanges 82 transversely spaced a distance substantially equal to the width of the backhoe bucket 35. A transverse wall 83 extending between the fore-and-aft extending sidewalls 82 is of a configuration to conform to the shape of the back side 36 of the backhoe bucket 35. As a result, the loader bucket 80 can be positioned snugly against the back side 36 of the backhoe bucket 35 and fixed into position by a pair of connecters 84, which can be in the form of mounting pins, interengaging corresponding holes in the fore-and-aft extending mounting flanges 82 and the sides of the backhoe bucket 35. The mounting apparatus 81 could be literally recessed into the cavity 85 of the loader bucket 80, whereby the back side 36 of the backhoe bucket 35 could form the transverse wall 83 without the need to have a separate transverse wall 83, or, alternatively, could project rearwardly from the back wall of the loader bucket 80 so that the capacity of the bucket cavity 85 would not be diminished. The hydraulic cylinder 37 controlling the motion of the backhoe bucket 35 relative to the articulated boom 32 will also control the attitude of the loader bucket 80 since it is connected directed to the backhoe bucket 35.

It will be understood by one skilled in the art that an earthworking machine 10 configured as described above will be operable to function as a backhoe, loader, grader and also as a dozer when utilized with a dozer blade equipped similarly to the loader bucket 80 described above. The telescopible front wheel assembly 15 can be positioned rearwardly toward the rear wheels 14 when the machine 10 is utilized as a backhoe or loader so as to give the earthworking tools 35,80 sufficient room to operate both forwardly and laterally of the machine 10 by virtue of the rotatable carriage 20 upon which the backhoe assembly 30 is rotatably mounted. When the machine 10 is utilized as a grader, the front wheel assembly 15 can be extended forwardly away from the rear wheels 14 through actuation of the hydraulic cylinder 18 to permit a greater control of the scraper assembly 50 as is desirable with such machines. The canting of the backhoe assembly 30 about the horizontal axis 48 permits the backhoe 80 to be utilized in situations heretofore unrealized without limiting the range of motion of the earthworking tool 35,80.

It will be understood that various changes in the details, materials, steps and arrangements of parts which have been described and illustrated to explain the nature of the invention, will occur to and may be made by those skilled in the art upon a reading of the disclosure within the principles and scope of the invention. The foregoing description illustrates preferred embodiments of the invention. However, concepts, as based upon such a description, may be employed in other embodiments without departing from the scope of the invention. Accordingly, the following claims are intended to protect the invention broadly, as well as in the specific form shown herein.

Having thus described the invention,

What is claimed is:

1. An earthworking machine comprising:

a mobile frame adapted for movement over the ground;

a carriage rotatably mounted on said frame for rotative movement about a generally vertical axis, said carriage carrying an operator's platform; and a backhoe assembly pivotally mounted on said carriage for movement about a vertical pivot axis and including an extensible articulated boom and a movable tool connected to the end of said boom, said backhoe assembly being pivotable about a first, generally horizontal pivot axis extending outwardly from said carriage to permit a canting of said articulated boom relative to said carriage such that the plane of extensible operation of said articulated boom can be positionable in a non-vertical plane passing through said first horizontal pivot axis.

2. The earthworking machine of claim 1 wherein said backhoe assembly further includes a mounting frame pivotally connecting said articulated boom for pivotal movement about a second pivot axis extending perpendicular to said first pivot axis to permit pivotal movement of said boom relative to said mounting frame for extension and contraction of said boom, said mounting frame being connected to said carriage for rotation about said first pivot axis.

3. The earthworking machine of claim 2 wherein said mounting frame is connected to an inner race of a thrust ring, said thrust ring having an outer race affixed to said carriage, said inner race being rotatably supported by said outer race to permit rotation of said mounting frame affixed thereto.

4. The earthworking machine of claim 3 wherein a linear actuator interconnects said carriage and said mounting frame to control the rotational movement of said mounting frame about said first pivot axis.

5. The earthworking machine of claim 4, wherein said thrust ring is circular in shape, said first pivot axis being defined by the center of said thrust ring.

6. The earthworking machine of claim 5 wherein said linear actuator limits the rotational movement of said mounting frame to a range of approximately forty-five degrees to each side of a position corresponding to a generally vertical orientation of said articulated boom.

7. In an earthworking machine having a mobile frame adapted for movement over the ground; a carriage pivotally supported on said frame for rotation relative thereto about a generally vertical axis; an earthworking implement connected to said carriage to engage the surface of the ground beyond said frame, said earthworking implement including an extensible, articulated boom carrying a working tool; and power means supported by said frame to operatively power the operation of said earthworking implement and the movement of said earthworking machine over the ground, the improvement comprising:

said earthworking implement is pivotally connected to said carriage for rotative movement relative thereto about first and second generally horizontal pivot axes extending perpendicular to each other, said first pivot axis extending outwardly from said carriage to permit a canting of said articulated boom relative to said carriage such that the plane of operation thereof can be positionable in a non-vertical plane, said second pivot axis mounting said articulated boom to permit extensible movement thereof relative to said carriage.

8. The earthworking machine of claim 7 wherein said second pivot axis is movable around said first pivot axis and permits an extension and contraction of said articulated boom throughout the entire range of movement of said articulated boom about said first pivot axis.

9. The earthworking machine of claim 8 wherein said second pivot axis is carried by a mounting frame connected to said carriage for rotation about said first pivot axis, said articulated boom being pivotally connected at one end thereof to said mounting frame for extensible movement relative thereto from said second pivot axis.

10. The earthworking machine of claim 9 wherein said mounting frame is connected to an inner race of a circular thrust ring, said thrust ring having an outer race affixed to said carriage, said inner race being rotatably supported by said outer race to permit rotation of said mounting frame relative thereto, said first pivot axis corresponding to the center of said thrust ring.

11. The earthworking machine of claim 10 wherein a hydraulic cylinder interconnects said carriage and said mounting frame to control the rotational movement of said mounting frame about said first pivot axis.

12. The earthworking machine of claim 11 wherein said hydraulic cylinder is operable to rotate said mounting frame through an angular rotation of approximately ninety degrees.

13. An earthworking machine comprising:

a mobile frame adapted for movement over the ground;

a carriage rotatably mounted on said frame for rotation about a generally vertical axis of rotation, said carriage supporting an operator's station directed toward a front face of said carriage;

a generally circular thrust ring having an inner race rotatably supported by an outer race to permit rotational movement therebetween, said outer race being affixed to the front face of said carriage, the center of said thrust ring defining a horizontal axis of rotation for the rotative movement of said inner race; and a backhoe assembly including a mounting frame connected to the inner race of said thrust ring to be rotatable therewith, an articulated boom pivotally connected at one end to said mounting frame for pivotal movement about a pivot axis extending perpendicular to and being rotatable about said horizontal axis of rotation, and an earthworking tool movably connected to an opposing end of said articulated boom, said backhoe assembly being operable to engage said earthworking tool with the ground beyond said frame.

14. The earthworking machine of claim 13 wherein said carriage is rotatable about said vertical axis of rotation through an angular rotation of at least 270 degrees.

15. The earthworking machine of claim 14 wherein a hydraulic cylinder interconnecting the front face of said carriage and said mounting frame is operable to control the rotational movement of said mounting frame about said horizontal axis of rotation.

16. The earthworking machine of claim 15 wherein said hydraulic cylinder is operable to move said mounting frame through an angular rotation of approximately ninety degrees.

* * * * *